US006024767A

United States Patent [19]

Telesca et al.

[11] Patent Number: 6,024,767

[45] **Date of Patent: *Feb. 15, 2000**

[54] HOME DRYER DRY CLEANING AND FRESHENING SYSTEM EMPLOYING DISPENSING DEVICES

[75] Inventors: Josephine Telesca, Stamford, Conn.; Jeanne Marie Weller, Glen Rock, N.J.; Frank Anthony Lucia, III, Oak Ridge, N.J.; Tracy Ann Ryan, Rivervale, N.J.; Robert Henry Buckenmayer, Montville, N.J.; Walter Ronald Paul, Whitehouse Station, N.J.; Ashwinkumar C. Gandhi, Toms River, N.J.

[73] Assignee: Reckitt & Colman Inc., Wayne, N.J.

[ * ] Notice: This patent is subject to a terminal disclaimer.

[21] Appl. No.: 08/665,470

[22] Filed: Jun. 18, 1996

[30] Foreign Application Priority Data

| | | | |
|---|---|---|---|
| Jun. 22, 1995 | [GB] | United Kingdom | 9512687 |
| Mar. 7, 1996 | [GB] | United Kingdom | 9604879 |

[51] Int. Cl.[7] ..... D06L 1/00; C11D 17/00

[52] U.S. Cl. ..... 8/142; 8/137; 510/281; 510/282; 510/283; 510/284; 510/285; 510/289; 510/291; 510/293; 510/295; 510/297

[58] Field of Search ..... 8/137, 142; 510/281, 510/282, 283, 284, 285, 289, 291, 293, 295, 297

[56] References Cited

U.S. PATENT DOCUMENTS

| | | | |
|---|---|---|---|
| 3,432,253 | 3/1969 | Dixon et al. | 8/142 |
| 3,813,221 | 5/1974 | Stubits | 8/142 |
| 3,859,225 | 1/1975 | McKnight et al. . | |
| 3,910,855 | 10/1975 | Abeles . | |
| 3,953,353 | 4/1976 | Barrett, Jr. et al. . | |
| 4,097,397 | 6/1978 | Mizutani et al. . | |
| 4,231,744 | 11/1980 | Moot | 8/495 |
| 4,336,024 | 6/1982 | Denisenko et al. | 8/142 |
| 4,430,468 | 2/1984 | Schumacher | 524/109 |
| 4,435,346 | 3/1984 | Ito et al. . | |
| 4,548,954 | 10/1985 | Smith et al. | 521/52 |
| 4,563,483 | 1/1986 | Smith et al. | 521/111 |
| 4,594,362 | 6/1986 | Smith et al. | 521/52 |
| 4,613,646 | 9/1986 | Sandvick | 524/476 |
| 4,632,772 | 12/1986 | Garabedian et al. . | |
| 4,670,171 | 6/1987 | Magyar . | |
| 4,680,143 | 7/1987 | Edge et al. . | |
| 4,685,930 | 8/1987 | Kasprzak | 8/139.1 |
| 4,720,351 | 1/1988 | Flynn et al. . | |
| 4,738,791 | 4/1988 | Ertle . | |

(List continued on next page.)

FOREIGN PATENT DOCUMENTS

| | | |
|---|---|---|
| 0 429 172 A1 | 5/1991 | European Pat. Off. . |
| 0429172 A1 | 5/1991 | European Pat. Off. . |
| 26 28 480 | 1/1978 | Germany . |
| 1 471 886 | 4/1977 | United Kingdom . |
| 1 536 936 | 12/1978 | United Kingdom . |
| 1 598 911 | 9/1981 | United Kingdom . |
| 1598911 | 9/1981 | United Kingdom . |
| 2 169 916 | 7/1986 | United Kingdom . |
| WO 91/14038 | 9/1991 | WIPO . |
| WO 95/31523 | 11/1995 | WIPO . |

OTHER PUBLICATIONS

Copy of GB Search Report dated May 29, 1996 for GB Application No. 9604828.5.

Copy of GB Search Report dated Jul. 2, 1996 for GB Application No. 9604849.1.

(List continued on next page.)

*Primary Examiner*—Alan Diamond

*Attorney, Agent, or Firm*—Fish & Richardson P.C.

[57] ABSTRACT

A dryer dry cleaning and freshening system is provided with a containment bag, a dispenser means impregnated with liquid cleaning composition, and a absorber capable of absorbing loose particles and excess cleaning composition A process for cleaning a garment is also provided. The system and process may be used in a home clothes dryer for dry cleaning.

29 Claims, 1 Drawing Sheet

U.S. PATENT DOCUMENTS

| | | | |
|---|---|---|---|
| 4,738,792 | 4/1988 | Ertle . | |
| 4,834,900 | 5/1989 | Soldanski et al. . | |
| 4,880,569 | 11/1989 | Leng et al. . | |
| 4,992,107 | 2/1991 | Itoku et al. | 134/27 |
| 5,205,960 | 4/1993 | Kristopeit et al. . | |
| 5,238,587 | 8/1993 | Smith et al. | 510/281 |
| 5,547,476 | 8/1996 | Siklosi et al. | 8/142 |
| 5,687,591 | 11/1997 | Siklosi et al. | 68/212 |
| 5,746,776 | 5/1998 | Smith et al. | 8/142 |
| 5,865,851 | 2/1999 | Sidoti et al. | 8/142 |
| 5,876,462 | 3/1999 | Weller et al. | 8/142 |

OTHER PUBLICATIONS

Copy of GB Search Report dated Jul. 3, 1996 for GB Application No. 9604884.8.

Copy of GB Search Report dated Oct. 29, 1996 for GB Application No. 9612979.6.

Copy of GB Search Report dated May 29, 1996 for GB Application No. 9604880.6.

Copy of GB Search Report dated Oct. 29, 1996 for GB Application No. 9612979.6.

Copy of GB Search Report dated Oct. 30, 1996 for GB Application No. 9612980.4.

Copy of International Search Report dated Nov. 29, 1996 for Application No. PCT/US96/10558.

Copy of International Search Report dated Dec. 26, 1996 for Application No. PCT/US96/10559.

Copy of International Search Report dated Nov. 26, 1996 for Application No. PCT/US96/10556.

HOME DRYER DRY CLEANING AND FRESHENING SYSTEM EMPLOYING DISPENSING DEVICES

This invention generally relates to a system for dry cleaning and freshening garments. More particularly the present invention relates to a dry cleaning and freshening system which utilizes a dryer apparatus, as well as a method of dry cleaning and freshening garments, particularly in a domestic setting.

Certain methods of dry cleaning and freshening garments have been described in the relevant prior art.

Smith et al., in U.S. Pat. No. 5,238,587, issued Aug. 24, 1993 discloses a method for cleaning soiled fabric articles comprising tumbling the soiled articles in a rotary clothes dryer at an elevated temperature, in a closed system, such as a sealed plastic bag. The system also includes a fabric-cleaning article comprising a porous substrate sheet impregnated with a gel liquid cleaning composition. Such a system however is not without its shortcomings. When a gelling agent is used as the cleaning composition, a visible residue may be deposited on the garment to be cleaned. Further, a gel is only needed to coat sheets of material which do not otherwise absorb a sufficient amount of dry-cleaning composition. Additionally, when a gelled dry-cleaning composition is employed, a temperature sufficient to cause release of the dry-cleaning coating composition from the cleaning sheet is required.

Denissenko et al., in U.S. Pat. No. 4,336,024 issued Jun. 22, 1982 discloses a process for cleaning clothes at home with the aid of a solvent by treating the article of clothing with a cleaning agent comprising at least one organic solvent, and then laying the article of clothing flat on an absorbent sheet, and laying the article of clothing and absorbent sheet flat on the interior surface of a the drum of a washing machine in order to spin it. The process may be carried out in two successive stages using a stain-removing agent and a rinsing agent. The garments must however, be held against the sheet on the interior surface of the drum, where they of course are subject to the effects of gravity and thus require the use of clips or straps in order to retain their positions until centripetal forces retain them against the drum's inner wall surface.

Accordingly, there is a need for a dryer dry cleaning and freshening system employing an absorbent material which is capable of absorbing a sufficient amount of dry-cleaning fluid. Further, there is a need for a dryer dry cleaning and freshening system which does not result in the deposition of a visible residue on the garment to be cleaned. Additionally, there is a need for a dryer dry cleaning and freshening system employing low temperature levels. There is a need for the above systems for use at home.

It is an object of the invention to provide a dryer dry cleaning and freshening system.

A further object of the invention is to provide a dryer dry cleaning and freshening system which is inexpensive and simple to use.

It is a further object of the invention to provide a dryer dry cleaning and freshening system which does not result in a deposition of a visible residue on the garments to be cleaned.

It is another object of the invention to provide a dryer dry cleaning and freshening system for use at low temperatures.

It is another further object of the invention to provide a process for cleaning a soiled garment with a cleaning composition in a dryer particularly a domestic clothes dryer.

It is an additional object of the invention to provide a process for refreshening a garment with a freshening composition in a dryer.

It is an object of the invention to provide the above systems and processes for use in the home.

These and other objects of the invention are accomplished by providing a dryer dry cleaning and freshening system comprising a containment bag, a dispenser means impregnated with liquid cleaning composition, and an unimpregnated absorber means capable of absorbing loose particles and excess liquid cleaning composition.

In a preferred embodiment of the invention a process for cleaning a garment with a liquid cleaning composition comprises the steps of placing at least one garment, a dispenser means material impregnated with the liquid cleaning composition and an absorber means capable of absorbing loose particles and excess liquid cleaning composition in a containment bag, fastening the containment bag, tumbling the containment bag and its contents in a clothes dryer at low temperature and removing the cleaned garment from the clothes dryer and containment bag.

In another preferred embodiment of the invention a process for freshening a garment with a fragrance composition comprises the steps of placing at least one garment, a dispenser means impregnated with the fragrance composition and an absorber means capable of absorbing excess fragrance composition in a containment bag, fastening the containment bag and its contents in a clothes dryer at low temperature, and removing the freshened garment from the clothes dryer and containment bag.

In a yet further embodiment of the invention, either of the above recited processes is practiced with a liquid cleaning and fragrancing composition.

In a still further embodiment of the invention there is provided a process for the cleaning and/or freshening of garments in the home.

The above and other objects, aspects, features and advantages of the invention would be more readily apparent from the description of the preferred embodiments taken in conjunction with the accompanying drawings and appended claims.

It is to be understood that the invention is illustrated by way of example and not by way of limitation, and in the figures of the accompanying drawings like references denote like and corresponding parts and in which;

BRIEF DESCRIPTION OF THE DRAWINGS

Referring to FIG. 1, a dryer dry cleaning and freshening system in accordance with the invention is shown with the garment to be cleaned.

Figure 1:
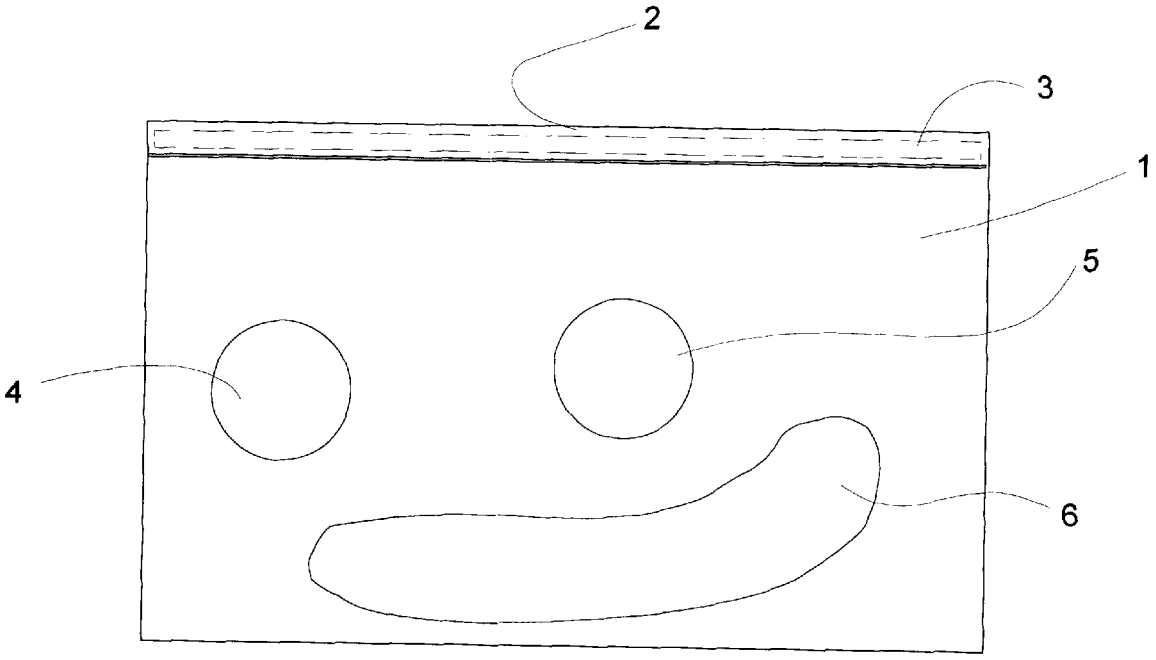
FIG. 1 is a schematic drawing a dryer dry cleaning and freshening system and a garment to be cleaned and freshened according to an embodiment of the invention.

The dryer dry cleaning and freshening system shown in FIG. 1 includes a containment bag 1 having an opening 2 conveniently placed at one side thereof With reference to containment bag 1 it may be fabricated of a material which is vapor impermeable material such as a plastic or polymer material such as from a sheet or film which is sewn, as well as certain non-woven textiles and formed materials, such as TYVEK (DuPont Corp., Wilmington Del.) and the like. Such a containment bag is typically sealed or otherwise fastened on one or more edges in order to form said containment bag 1, and any conventional means for its production may be used. Such sealing or fastening means include for example sewing, welding, melt-bonding as well as other conventionally known means. It is further to be understood that while a vapor impermeable material may be used in the construction of the containment bag 1, it is to be understood that such a bag itself need not be totally hermetically sealable itself and that the escape of vapors or gases from within such a containment bag 1 to its exterior, such as the interior space of a clothes dryer is to be foreseen. Such an escape of vapors may occur at seams of said containment bag 1, particularly where sewn seams are present, as well as from the sealable opening 2. Alternately, the containment bag 1 may be fabricated of a material which is vapor permeable, such as a woven or non-woven textile material, which may be made of naturally occurring or synthetically produced fibers, as well as blends of two or more different materials. Both the vapor permeable materials and the non-vapor permeable materials may be a single layer material, or may be of a multilayer construction such as two or more layers of differing materials layered in register. Examples of such include a first layer of a non-woven material which is used in the innermost layers of the containment bag 1, which is in turn layered with a non-woven material such as a polymer film layer which desirably provides a vapor impermeable barrier layer to the containment bag. A second example of multilayer containment bag construction includes a first innermost layer which is a fibrous material, such as a non-woven material and a second layer in register therewith of a non-woven vapor impermeable synthetic paper-like material such as TYVEK material which is used to form the exterior of the containment bag 1. Such a construction provides the advantage of providing a vapor impermeable containment bag 1, which has a durable exterior layer which in turn increases the operating life of such a containment bag. Further, the exterior material made of TYVEK or a similar material is readily printable using known art techniques which permits the printing of a legend, logo or instructions for use on this exterior surface of the containment bag 1. A third preferred material of construction useful in the fabrication of a containment bag 1 is a two or three layered construction, wherein the first and innermost layer of the containment bag 1 is of a non-woven, fibrous material such as of a synthetically produced fiber, which in turn is bonded to a second spun bonded polymeric textile material, which imparts strength to such a containment bag construction. Optionally, but desirably a third layer of a non-woven, fibrous material is bonded to the remaining side of the spun bonded polymeric textile material and thus forms the exterior of the containment bag 1. The fibrous material used in the formation of this third layer may be of the same synthetically produced fiber of the first, innermost layer or it may be of a different fiber.

A further and most preferred material of construction for the fabrication of the containment bag 1 is a vapor impermeable or poorly vapor permeable bilayered material which has on its first layer a polymeric film, which is bonded to a second layer of a polymeric spun bonded nonwoven textile material. Both the polymeric film and the polymeric spun bonded nonwoven textile material may be produced from a variety of known art polymers and copolymers including for example nylons, polyalkylene terephthalates, rayon, as well as polyalkylenes especially polyethylene, polypropylene and polybutylene being of particular advantage due to their low cost and ready fabrication into both vapor impermeable films as well as nonwoven textile materials. The bonding between these layers may be accomplished by virtually any known means, including for example heat bonding, resin bonding which may require the use of a bonding material or film intermediate to the first film layer and second film layers, as well as ultrasonic bonding methods which provide effective binding between these two materials and which may be practiced to produce an attractive dimpled appearance on the final material. In accordance with this most preferred embodiment, the containment bag 1 is constructed such that the first film layer forms the interior of the containment bag, and the second film layer forms the exterior of the containment bag 1. A first advantage of this most preferred containment bag 1 construction is that the interior film layer of the bag is both vapor impermeable and is nonabsorbent of the liquid cleaning composition and thus the maximum cleaning efficacy of these compositions is available to the clothes or other textiles being treated in the process according to the invention. A second advantage of the preferred construction is the inventors' observation that such a containment bag 1 billows sufficiently during the tumbling and heating it encounters in the dryer apparatus, yet permits the escape of vapors produced or entrapped within the containment bag to escape at an acceptable rate. A third advantage enjoyed by the preferred construction is the durability of such a containment bag 1 as the nonwoven film layer which forms the exterior of the bag is resistant to tearing, and at the same time the soft tactile characteristics of this layer make the bag especially attractive from the standpoint of the consumer.

Other advantageous materials of construction for the fabrication of containment bags 1 which are alternative especially preferred embodiments having a vapor impermeable or poorly vapor permeable bilayered material which has on its first layer a polymeric film, which is bonded to a second layer of a textile material include for example: a first vapor impermeable layer of a copolymer film or a film formed from a blend of polymers including for example: polyethylene terephthalate—polybutylene terephthalae; polyethylene terephtalate—rayon which are in turn bonded to second layer of a polymeric nonwoven textile material which may be for example: rayon, and spun bonded or melt blown polyethylene or polypropylene textile materials. Such materials of construction useful for the fabrication of containment bags 1 which may be produced from these immediately above recited include: a first layer of a polyalkylene film, such as polyethylene or polypropylene bonded to a second layer of a textile material based on a blend of rayon and polyethylene terephthalate; and, a first layer of a polyalkylene terephthalate film, bonded to a second layer of a rayon textile material.

It is to be understood that in any of the constructions recited which include one or more polymeric materials, that minor amounts of conventional additives may be included in conventional amounts including but not limited to: colorants, heat stabilizers, ultraviolet stabilizers and filler materials. Such are, per se, known to the art.

Both the first layers and the second layers may be of the same or different thicknesses, and it is required only that the containment bag 1 formed from these materials be flexible. Most desirably however, the thicknesses of both the first and second layer are less than about 20 mils, more desirably the thickness of the first, preferably vapor impermeable layer is 5 mils and less, especially 3 mils and less, while the thickness of the second layer and any further layer is about 5 mils and less.

The dimensions of the containment bag 1 and its internal volume may vary considerably. Desirably however, the containment bag 1 is sufficiently large to contain at least one garment or textile to be treated, but preferably 2–3 such garments, as well as the absorber means being taught herein, while at the same time not be overly large and thus be inconvenient for use in a domestic dryer apparatus. Advantageously the containment bag 1 has a volume of about 75 liters or less, with sizes of about 50 liters, and about 30 liters being preferred.

The opening 2 of the containment bag 1 is conveniently located at an edge of the containment bag 1, but it may be located elsewhere. The opening 2 may be a simple slit or discontinuity in the material of the bag's construction or it may take a more complex form such as further including a foldable flap to close the bag, or may also use fastening means 3. Suitable fastening means 3 may be any useful fastening means known to the art including, but not limited to one or more of the following: zippers, hook-and-loop type fasteners (VELCRO®), buttons, clips, pins, snaps, adhesive strips, as well as resealable plastic sealing elements such as two strips, one on each margin of the opening 2 when pressed together interlock to form a flexible seal. Such resealable plastic sealing elements are known to the art dealing with plastic bags and pouches, and are sometime referred to as ZIP-LOCK® type closures. Suitable fastening means 3 also includes the use of a simple drawstring to pull the opening 2 shut, the use of a single deformable wire-type "twist tie" to close the opening 2, as well as the use of one or more fastening means 3 in conjunction with a flap. Further conventionally known fastening means 3 although not elucidated here may also be used. In accordance with the convenient placement of the opening 2 at or near an edge of the containment bag 1, the fastening means 3 is placed at or about the edge of the bag as illustrated on FIG. 1. It is only required that the selected fastening means be affixable onto the materials of construction used to fabricate the containment bag 1, and that it form a relatively secure closure. Desirably, the containment bag 1 is closeable to provide a liquid seal to minimize the leakage of any liquid cleaning composition out of said bag and into the dryer, which in turn ensures that maximum cleaning effect is imparted to garments or other textile materials being treated.

As is further illustrated on FIG. 1, the system according to the invention further includes within the interior of the containment bag 1 a dispenser means 4 which is an article preferentially fabricated of a porous material which prior to the cleaning operation to be described more fully below is at least partially saturated, but desirably is completely saturated with a liquid cleaning composition. The system optionally but in some cases desirably further includes an absorber means 5 which is fabricated of a material capable of absorbing loose particles and excess liquid cleaning composition.

The dispenser means 4 is an article which may be formed of a porous material which is desirably a readily compressable foamed material such as is conventionally used in the production of synthetic sponges as well as other foamed polymeric materials known to the art. It is required only that such foamed polymeric materials be compressible, preferably readily manually compressible and that they be absorbent of the liquid cleaning composition. Desirably, the dispenser means 4 is an absorbent foam ball, or in an equally preferred alternative is an absorbent foam cube, both of which are impregnable with the cleaning composition to be used in the process.

When present, the absorber means 5 may be formed from the same material as the dispenser means 4, or may be made of a different material. Such absorber means 5 may take a variety of forms including sheets, pads, flakes, small or large spheres as well as finely comminuted absorbent solids such as those produced from absorbent polymers as well as various grades of cellulose, including cellulose materials derived from wood such as sawdust. Such absorber means 5 may be omitted, such as wherein a containment bag 1 construction is used having a fibrous layer forming the innermost layer of the bag. Such a fibrous layer has been observed to provide both good soil and particulate entrainment effects as well as good liquid absorbency aspects. Further, the omission of such an absorber means 5 also eliminates the requirement that it be separated from the cleaned garments and textiles at the conclusion of the process described in more detail following. When present, the absorber means 5 is formed of a foamed polymer material in the shape of a ball such as is illustrated on FIG. 1 or in the shape of a cube, or a sheet or pad particularly a flexible square or rectangular sheet or pad of a foamed polymer material or a nonwoven polymer material.

Where an absorber means 5 is present, it is contemplated that an amount of a fragrance or fragrancing composition is absorbed within which may provide a further fragrancing effect to the garment being treated in the process according to the invention.

The liquid cleaning composition used in the system being taught herein may be one or more of those known to the art. Generally, such a cleaning composition includes one or more organic solvents to aid in the dissolution of soils from a garment or textile, one or more surfactants, and may also include a fragrance composition to impart a specific scent or particular odor to the garments and which masks other odors, such as any undesirable chemical odors.

The dry cleaning and freshening system taught here advantageously may be used at home and provides for the removal of spots, freshening and dewrinking of clothing garments without the expense and inconvenience of taking soiled or stale-smelling clothes to a commercial dry cleaning establishment and picking the clothes up. The dryer dry cleaning and freshening system of the invention permits the user to lightly clean and freshen garments at home in a clothes dryer between dry cleaner visits. This reduces the overall cost of dry cleaning.

The garments which can be cleaned may include clothing, linens, draperies, rugs, usually small rugs, upholstery covers, and the like. The soiled garments may be stale-smelling due to odors such as tobacco smoke, residue, perfume, and perspiration. Additionally, the soiled garments may have visible spots and stains.

The dryer dry cleaning system of the present invention may be employed using a conventional home rotary hot air clothes dryer. However, any device that can tumble the system while supplying low heat without dispensing water may be used.

In one embodiment which is amongst preferred embodiments, both a dispenser means 4 and an absorber means 5 are provided. They are both fabricated in the shape of balls or cubes from a spongy foam material and are desirably of different colors so that the user can easily distinguish between the two. When packaged one or several such dispenser means 4 are provided with one or several absorber means 5, packaged separately in vapor and liquid impermeable pouches or other containers to prevent leaking of the cleaning composition during storage.

Figure 2:
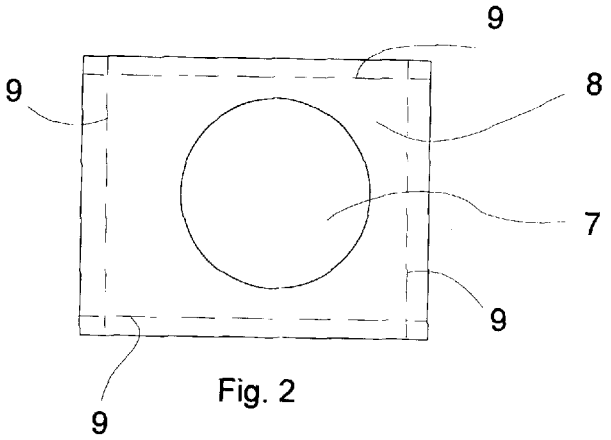
FIG. 2 is a schematic drawing of a ball shaped absorber means packaged in a vacuum-sealed pouch in accordance with the invention.

A preferred packaging construction is illustrated on FIG. 2, where there is shown a dispenser means 4 in the form of a ball 7 sealed in a pouch 8 made of a polymer film, here polyethylene. The polyethylene pouch 8 is conventionally formed by sealing with a impulse sealer two pieces of a polyethylene film on three sides to define the pouch, after which the ball shaped dispenser means 4 having absorbed within a quantity of the liquid cleaning composition is inserted. Said ball 7 is placed in the pouch 8, and the remaining side is sealed forming a sealed package having four non-permeable seals 9. The edges of the pouch may be trimmed. Where a dispenser means 4 is not impregnated with a liquid cleaning composition, it may be compressed to expel excess air prior to the sealing of the pouch.

In operation, the user opens one pouch containing a dispenser means 4 ball impregnated with liquid cleaning composition. The dispenser means 4 ball is placed in the containment bag 1 with one or more garments or textiles to be cleaned and freshened, and the containment bag 1 is fastened shut. The thus loaded containment bag 1 is then inserted into a conventional domestic clothes dryer and tumbled at a low temperature, such as a conventional "delicate garments" for a sufficient period to ensure adequate cleaning and/or freshening of the textile and garments. Typically a period of about ten to twenty minutes on such a low temperature setting has been found to be adequate. The containment bag is removed from the clothes dryer and the garments and textiles are removed from the containment bag 1 and placed on a hanger. The dispenser means 4 may be discarded while the containment bag 1 may be retained for a subsequent cleaning operation, or it too may be disposed of.

In an alternative to the above process, an absorber means 5, particularly in the shape of a ball formed from a spongy material is also introduced into the containment bag 1 with the dispenser means 4 ball. At the end of the process, the absorber means 5 is separated from the cleaned and freshened garments and textiles and may also be discarded. In a still further variation, the absorber means 5 is present and is used as described in the process above, except that it is in the form of a flexible sheet of a foam material or nonwoven textile material.

Additionally, the dryer dry cleaning and freshening system of the invention may include a quantity of stain remover, which is sometimes referred to as a spot cleaning composition. Such a spot cleaning composition, interchangeably referred to as a stain remover is a composition intended to be used for the localized cleaning of a stain, as opposed to a general cleaning composition which is intended to be applied to a garment or textile's overall surface. In operation, the spot cleaning composition may be applied to a garment before placement in the containment bag, and useful spot cleaning compositions include those which are known to the art and which are found effective at cleaning stains.

Further, in accordance with a further alternative embodiment of the system of the invention, there may also be included an additional quantity of a general cleaning composition in excess of that which is intended to be provided by the dispenser means 4. Such an additional quantity of liquid cleaning composition which may be added to the containment bag and/or generally upon the surface of one or more of the garments to be cleaned before fastening the containment bag 1 and placing it in the clothes dryer for tumbling.

In a further embodiment, the dispenser means 4 may be impregnated with a fragrance composition alone for freshening garments, exclusive of any cleaning composition.

The present invention is used in conjunction with a liquid cleaning composition. Typically such a liquid cleaning composition comprises one or more solvents and/or one or more surfactant constituents which may be employed to solubilize stains, and such cleaning compositions may be provided as part of an aqueous, or as part of an organic fluid delivery system. Compositions which comprise a fragrance constituent, with or without additional solvents and or surfactant constituents may also be used. Such surfactants and solvent, where present are generally known to aid in the removal of soils and stains from the garment or textile being treated in the process being taught herein.

Exemplary useful liquid cleaning compositions include those which are known to the skilled practitioner in the art, and include those disclosed in any of the patents which are recited above, the contents of which are herein incorporated by reference. Further useful cleaning compositions which may be used include those which are the subject of copending patent application Ser. No. 08/666,690, now U.S. Pat. No. 5,908,473 which are liquid cleaning compositions which are particularly useful as a home dry cleaning composition. These liquid cleaning compositions comprising the following constituents: 0.01–5% wt. (preferably 0.01–2.5% wt. ) nonionic surfactant which is preferably an alkoxylated primary or secondary alcohol and/or an alkoxylated phenol; 0.01–2.5% wt. anionic surfacant selected from alkyl sulfosuccinates, alkyl ether sulfosuccinates, alkylamide sulfosuccinates, alkyl sulfosuccinamates, as well as salt forms thereof; 0–1% wt. (preferably 0–0.1% wt) fluorosurfactant constituent including one or more of those which may be present in the spot cleaning composition; 0.01–7% wt. organic solvent selected from alcohols and glycol ethers especially water miscible alcohols and ethers, to 100% wt. of water, and further up to about 2% wt. (preferably 0–1% wt.) of one or more optional constituents. Desirably, these compositions are aqueous in nature and comprise about 90% wt. and more of water. Further useful compositions are those which are taught as localized stain treating compositions, viz., spot treatment compositions which are described in Ser. No. 08/666,690. Therein are described aqueous spot cleaning composition which comprises the following constituents: 0.1–10% wt. nonionic alkoxylated alcohol; 0.1–10% wt nonionic alkoxylated mono- and di-alkanol amide; 0.1–3.5% wt. anionic surfactant especially one or more selected from alkyl sulfosuccinates, alkyl ether sulfosuccinates, alkylamide sulfosuccinates, alkyl sulfosuccinamates, as well as salt forms thereof, 0–1% wt. flurosurfactant; 0.01–7% wt. alcohol solvent especially water miscible alcohols; 0.01–30% wt. glycol ether solvent, especially water miscible glycol ethers; to 100% wt. water. Optionally, these spot cleaning compositions may include up to about 2% wt. of one or more conventional additives such as acids, bases, pH buffers, coloring agents, fragrances and the like. Desirably, these spot cleaning compositions comprise at least about 70% wt. water. The contents of both of these applications are herein incorporated by reference.

Other compositions may be used as well including many known art compositions which include a proportion of one or more water miscible organic solvents such as one or more alcohols, polyols, ketones, or glycol ethers. Pyrrolidinone solvents are also known, as well as conventional chlorinated dry-cleaning solvent and mixtures of the foregoing as long as the final cleaning composition has a flash point above 160° F.

Many known art compositions include one or more surfactants, including nonionic surfactants as well as amphotheric solvents.

Exemplary nonionic surfactants include condensation products of ethylene oxide with a hydrophobic polyoxyalkylene base formed by the condensation of propylene oxide with propylene glycol. Preferred nonionic surfactants include the condensation products of $C_8$–$C_{22}$ alkyl alcohols with 2–50 moles of ethylene oxide per mole of alcohol.

Preferred nonionic surfactants also include ($C_8$–$C_{24}$) fatty acid amides, e.g. the monoamides of a mixture of arachidic and behenic acid and the mono- or di-alkanolamides of ($C_8$–$C_{22}$) fatty acids. Further nonionic surfactants which may be employed include the ethylene oxide esters of $C_6$–$C_{12}$ alkyl phenols such as (nonylphenoxy) polyoxyethylene ether. Other nonionics include the ethylene oxide esters of alkyl mercaptans, the ethylene oxide esters of fatty acids and the lauric ester of methoxypolyethylene glycol, the ethylene oxide ethers of fatty acid amides, the condensation products of ethylene oxide with partial fatty acid esters of sorbital, wherein the mole ratio of ethylene oxide to the acid, phenol, amide or alcohol is about 5–50:1. Amphoteric surfactants many of which are known to the art, including ($C_8$–$C_{22}$) allyl(dimethyl)amine oxides may also be present. Further useful amphoteric surfactants are known to the art, e.g., as disclosed in U.S. Pat. No. 3,936,538.

Certain general liquid cleaning compositions include certain cationic surfactants referred to as quaternary amines, which have been found to function as fabric conditioners, reducing static cling and lint adherence. Also useful in certain general cleaning compositions are certain imidazolinium salts and useful amine salts like the stearyl amine salts that are soluble in water.

Additionally water may be present in the liquid cleaning composition. Generally, sufficient water is employed to aid in the removal of water based stains.

The liquid cleaning composition and fragrance composition should be such that there is little or no skin and eye irritation and preferably, no toxicity. Preferably a sufficient quantity of liquid cleaning composition is provided to clean three garments per dry cleaning load.

The liquid cleaning composition should also exhibit a sufficiently low flash point so to minimize and for all intents and purposes eliminate the likelihood of combustion when used in the cleaning process described above.

The liquid cleaning composition may include a fragrance, deodorant, preservative, insect repellent such as cedar oil, a coloring agent, finishing agents, fumigants, lubricants, and fungicides, as long as the additives do not interfere with the operation of the composition. The liquid cleaning composition may also include amounts of a thickener or gelling agent.

As used in this specification the term "liquid cleaning composition" is to be understood to encompass cleaning compositions which may or may not include one or more "freshening" agents, typically one or more fragrances which are directed to provide a freshening effect.

Although the invention has been described with reference to the preferred embodiments, it will be apparent to one skilled in the art that variations and modifications are contemplated within the spirit and scope of the invention. The drawings and the description of the preferred embodiments are made by way of example rather than to limit the scope of the invention, and it is intended to cover within the spirit and scope of the invention all such changes and modifications.

We claim:

1. A dryer dry cleaning and freshening system comprising:

a containment bag;

a compressible foam dispenser means in the form of a ball or cube, and which is impregnated with a liquid cleaning composition; and an unimpregnated absorbing means capable of absorbing loose particles and excess liquid cleaning composition.

2. A dryer dry cleaning and freshening system according to claim 1, further comprising a fragrance composition mixed in with the liquid cleaning composition.

3. A dryer dry cleaning and freshening system according to claim 1, wherein said containment bag is vapor impermeable.

4. A dryer dry cleaning and freshening system according to claim 1, wherein said containment bag includes a fastener.

5. A dryer dry cleaning and freshening system according to claim 1, wherein said dispenser means and said absorbing means are foam.

6. A dryer dry cleaning and freshening system according to claim 1, wherein said dispenser means is a ball.

7. A dryer dry cleaning and freshening system according to claim 1, wherein said absorbing means is a ball.

8. A dryer dry cleaning and freshening system according to claim 1, wherein said dispenser means and said absorbing means are color-coded.

9. A dryer dry cleaning and freshening system according to claim 1, wherein said dispenser means and said absorbing means are vacuum-sealed for packaging.

10. A dryer dry cleaning and freshening system according to claim 1, wherein said dispenser means and said absorbing means are disposable.

11. A dryer dry cleaning and freshening system according to claim 1, wherein said dispenser means is impregnated with liquid cleaning composition before packaging.

12. A dryer dry cleaning and freshening system according to claim 1, wherein said dispenser means and said absorbing means are each separately sealed in a pouch with a non-permeable seal.

13. A dryer dry cleaning and freshening system according to claim 1, and further comprising a quantity of stain remover for direct application to a stain.

14. A dryer dry cleaning and freshening system according to claim 1, and further comprising an additional quantity of liquid cleaning composition to add into said containment bag.

15. A dryer dry cleaning and freshening system according to claim 1 wherein the containment bag comprises a non-woven textile.

16. A dryer dry cleaning and freshening system according to claim 1 wherein the containment bag comprises a woven textile material.

17. A dryer dry cleaning and freshening system according to claim 1 wherein the containment bag is of a multilayer construction comprising two or more layers of differing materials layered in register.

18. A dryer dry cleaning and freshening system according to claim 17 wherein the containment bag includes a non-woven material forming the innermost layers of the containment bag and a vapor impermeable polymer film layer which forms the outermost layers of the containment bag.

19. A dryer dry cleaning and freshening system according to claim 17, wherein the containment bag includes a non-woven fibrous material forming the innermost layers of the containment bag, wherein said non-woven material is bonded to a spun-bonded polymeric textile material.

20. A dryer dry cleaning and freshening system according to claim 19 wherein the containment bag further includes a third outermost layer of a non-woven, fibrous material bonded to the remaining side of the spun bonded polymeric textile material layer.

21. A dryer dry cleaning and freshening system according to claim 17 wherein the containment bag is formed of a bilayered material which includes a first polymeric film layer, bonded to a second layer of a polymeric spun bonded nonwoven textile material.

22. A process for cleaning a garment with a liquid cleaning composition comprising the steps of:

placing at least one garment, a compressible foam dispenser means in the form of a ball or cube, and which is impregnated with said liquid cleaning composition, and an unimpregnated absorber capable of absorbing loose particles and excess liquid cleaning composition in a containment bag;

fastening said containment bag;

tumbling said containment bag and contents in a clothes dryer; and removing the cleaned garment from said clothes dryer and containment bag.

23. The process according to claim 22, further comprising disposing of said dispenser means and said absorber.

24. The process according to claim 23, further comprising removing said dispenser means from vacuum sealed packages before placement in said containment bag.

25. The process according to claim 22, further comprising applying stain remover to said garment before placement in said containment bag.

26. The process according to claim 22, further comprising adding liquid cleaning composition to said containment bag before fastening said bag and tumbling.

27. The process according to claim 22, further comprising tumbling for about 10 minutes.

28. The process according to claim 22, wherein said liquid cleaning composition includes a fragrance for freshening.

29. A process for freshening a garment with a fragrance composition comprising the steps of:

placing at least one garment, a compressible foam dispenser means in the form of a ball or cube, and which is impregnated with said fragrance composition, and a absorber capable of absorbing excess fragrance composition in a containment bag;

fastening said containment bag;

tumbling said containment bag and contents in a clothes dryer, and removing the freshened garment from said clothes dryer and containment bag.

* * * * *

UNITED STATES PATENT AND TRADEMARK OFFICE
CERTIFICATE OF CORRECTION

PATENT NO. : 6,024,767

DATED : FEBRUARY 15, 2000

INVENTOR(S) : TRACY ANN RYAN, ROBERT HENRY BUCKENMAYER, JOSEPHINE TELESCA, MS. JEANNE MARIE WELLER, WALTER RONALD PAUL, ASHWINKUMAR C. GANDHI AND FRANK ANTHONY LUCIA III

It is certified that error appears in the above-identified patent and that said Letters Patent is hereby corrected as shown below:

On the title page, in the 4th line of the "Abstract", after the word "composition", insert a ".".

At column 12, line 12, delete "a" and insert --an unimpregnated--.

Signed and Sealed this

Fifth Day of December, 2000

*Attest:*

*Attesting Officer*

Q. TODD DICKINSON

*Director of Patents and Trademarks*